United States Patent [19]

Hendren

[11] Patent Number: 4,971,449

[45] Date of Patent: Nov. 20, 1990

[54] DRUM TYPE AGITATING AND MIXING MACHINE

[75] Inventor: Charles W. Hendren, Cincinnati, Ohio

[73] Assignee: American Laundry Machinery Inc., Cincinnati, Ohio

[21] Appl. No.: 454,062

[22] Filed: Dec. 19, 1989

[51] Int. Cl.[5] ..... B01F 9/06; D06F 21/04

[52] U.S. Cl. ..... 366/228; 366/105; 68/58

[58] Field of Search ..... 68/58, 142; 366/228, 366/101, 105, 106, 107, 57, 167

[56] References Cited

U.S. PATENT DOCUMENTS

| | | | |
|---|---|---|---|
| 1,020,618 | 3/1912 | Miller | 366/228 |
| 2,243,325 | 5/1941 | Windell | 68/58 |
| 2,584,070 | 1/1952 | Walker | 68/58 |
| 3,058,330 | 10/1962 | Grantham | 68/58 |
| 3,201,958 | 8/1965 | Smith | 68/58 |
| 3,997,292 | 12/1976 | Lutes et al. | 81/158 |

FOREIGN PATENT DOCUMENTS

| | | |
|---|---|---|
| 687094 | 5/1964 | Canada . |
| 805624 | 5/1957 | United Kingdom . |

OTHER PUBLICATIONS

Appliance Magazine, p. 49, Mar. 1989.

*Primary Examiner*—Harvey C. Hornsby
*Assistant Examiner*—G. Graham
*Attorney, Agent, or Firm*—Bacon & Thomas

[57] ABSTRACT

A drum type agitating and mixing machine for treating garments or fabric in liquid such as in washing or dyeing wherein a rotatable drum partially submerged in liquid along one side includes inwardly projecting hollow ribs arranged to contain air when the rib is outside the liquid in the machine. Each rib defines a pumping chamber having an inlet opening arrangement for liquid and an outlet arrangement for air trapped within the rib and the liquid that fills the rib so that liquid enters each rib from at one area of the rib and pumps air trapped within the rib out through an outlet arrangement which is axially spaced from the inlet. Flow of air out the outlet openings is slower than inflow of liquid into the chamber. Liquid contained within the rib drains therefrom through the outlet openings as each rib moves over the surface of liquid in the drum and is inverted. A one-way valve admits liquid into the rib chamber but does not let it flow in the reverse direction to ensure that liquid will drain from the outlet openings only. Pumping of air while the ribs are immersed causes air bubbles to be generated beneath the surface of the liquid in which the drum is rotated to promote intimate mixing of the liquid. The axial spacing of inlet and outlet transfers liquid axially within the drum.

12 Claims, 2 Drawing Sheets

FIG. 2
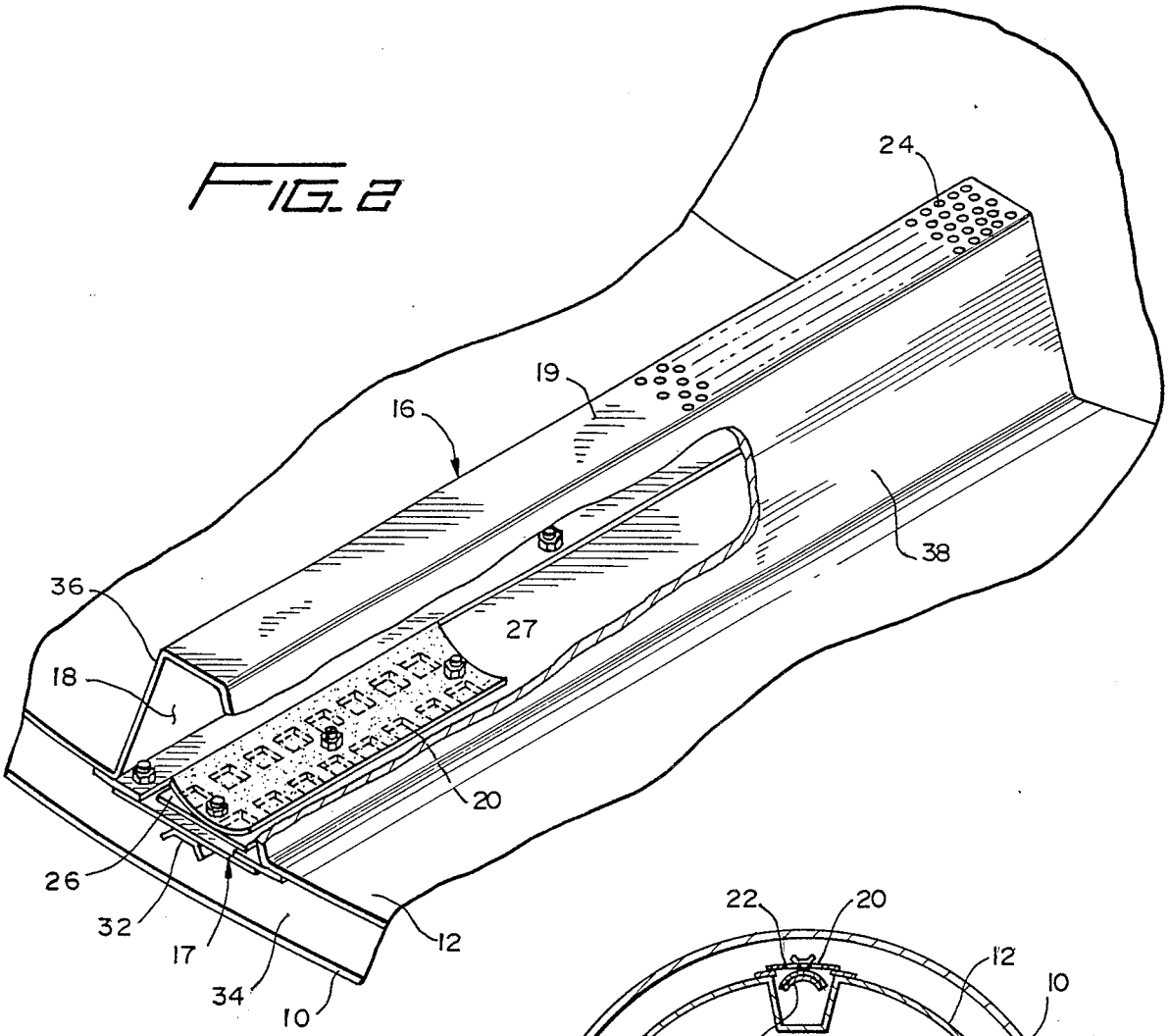
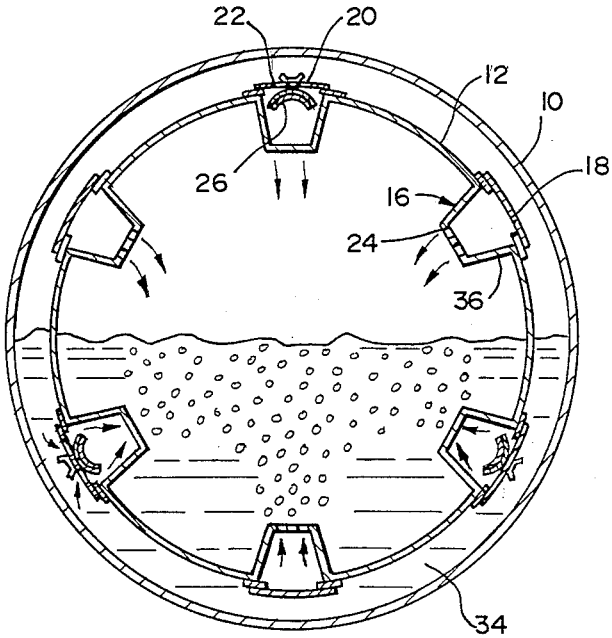
FIG. 4

DRUM TYPE AGITATING AND MIXING MACHINE

BACKGROUND OF THE INVENTION

1. Field of the Invention

This invention relates to a drum type agitating and mixing machine useful, for example, in laundering or dyeing fabric.

2. Description of Related Art

The use of rotating drum type agitating machines for laundering and dyeing fabric is generally known. It is conventional in such machines to utilize ribs projecting inwardly from the interior surface of the rotating drum to agitate the fabric within the drum and to enhance mixing of the laundering or dyeing liquid. For example, U.S. Pat. No. 2,584,070 issued to Walker on Jan. 29, 1952 illustrates a known drum type agitating and mixing machine for washing, dry cleaning or dyeing garments. The prior art system utilizes a rotatable drum partially immersed in liquid contained within an outer housing whereby, upon rotation of the inner drum, the peripheral portion of the inner drum periodically is submerged and rises above the body of liquid within the outer housing. As the drum periphery is submerged and moves through the liquid, perforated rib elements within the drum are caused to fill with liquid and then to carry the liquid up over the surface of the body of liquid within the outer housing and to drop it back into the main liquid body while thoroughly mixing the fabric in the rotating drum with the liquid.

The prior art systems generally are not concerned with trapping a body of air within an agitating drum rib and then causing the air to be pumped out of the rib while it is submerged in laundering or dyeing liquid to produce a bubble agitating effect. It has been discovered that such aeration of the liquid body enhances the mixing of the liquid particularly in dyeing agitators.

The prior art systems also are not concerned with transferring liquid axially within the drum by means of rib elements that receive liquid at one point along the rib and discharge the liquid at a point axially spaced from the inlet point on the rib. Such an action further increases the mixing ability of the drum agitator.

BRIEF SUMMARY OF THE INVENTION

The present invention comprises a drum type agitating and mixing machine employing at least one but preferably a plurality of longitudinally extending rib elements on the interior of the rotating drum. The rib elements extend generally parallel to the rotational axis of the drum such that, when a side of the drum is partially immersed in liquid and the drum rotated, the ribs are periodically immersed in the liquid, moved through the liquid and then moved above the surface of the liquid in a circular path. The ribs are provided with a liquid inlet aperture arrangement at one axial position on the rib and an air outlet aperture arrangement at a different, axially removed or spaced position on the rib usually facing inwardly towards the center of the drum. As the drum and its associated ribs move through the body of liquid, liquid flows in through the inlet aperture arrangement of each rib at its inlet area and forces air trapped within the ribs out through the outlet aperture arrangements at the outlet area while the ribs are submerged in the liquid.

As the ribs rotate upwardly out of the liquid as the agitating drum rotates, liquid that has been admitted at one end axial area along the rib is discharged at a different point axially removed from the inlet area to enhance mixing of the liquid through which the drum is rotated. Thus, it will be seen that, as each rib is immersed in liquid within the drum housing, liquid rapidly flows into the rib interior at an inlet area disposed at an axial position along the rib and air is progressively pumped out of the rib by the incoming liquid at a point axially removed from the inlet area. The inlet area is larger in cross sectional area than the outlet area to ensure rapid filling of the rib with a delayed outflow of air, such that air will continue to bubble through the body of liquid for a substantial period as the rib traverses the liquid. By the time the rib is ready to exit from the liquid, the rib is substantially full of the liquid, which is then carried up over the body of liquid and dropped back onto the surface of the liquid and through the articles contained in the drum from above.

Preferably, alternating ribs are provided with axially spaced inlet and outlet aperture arrangements to maximize the mixing effect of the air bubbles exiting the air outlet aperture arrangement on each rib. The axial spacing between inlet and outlet aperture arrangements can be provided by locating the inlet and outlet aperture arrangements at axially opposite ends of each rib. Alternatively, the inlet could be centrally located along the rib and the outlet apertures located at opposed ends of the rib.

A one-way valve arrangement is associated with the liquid inlet of each rib, the valve allowing liquid to flow into the rib interior but trapping the liquid against reverse flow through the liquid inlet apertures. Thus, liquid flowing into the rib interiors through the inlet arrangement effectively can only exit through the outlet apertures after the air has been blown from the interior of the rib while it was moving through the liquid. Thus, a desirable mixing effect is achieved by blowing air from the ribs into the body of liquid and then discharging the liquid generally downwardly within the interior of the drum above the surface of the body of liquid, while the clothing or fabric is agitated within the drum interior.

BRIEF DESCRIPTION OF THE DRAWINGS

With reference to the appended drawings, where like reference numerals denote like elements:

FIG. 2 is a detailed isometric view of a single pumping rib within the drum agitator shown in FIG. 1;

FIG. 4 is a transverse sectional view of the drum agitator and outer housing illustrating the air pumping action of the pumping ribs constructed in accordance with the invention.

DESCRIPTION OF THE PREFERRED EMBODIMENT

Figure 1:
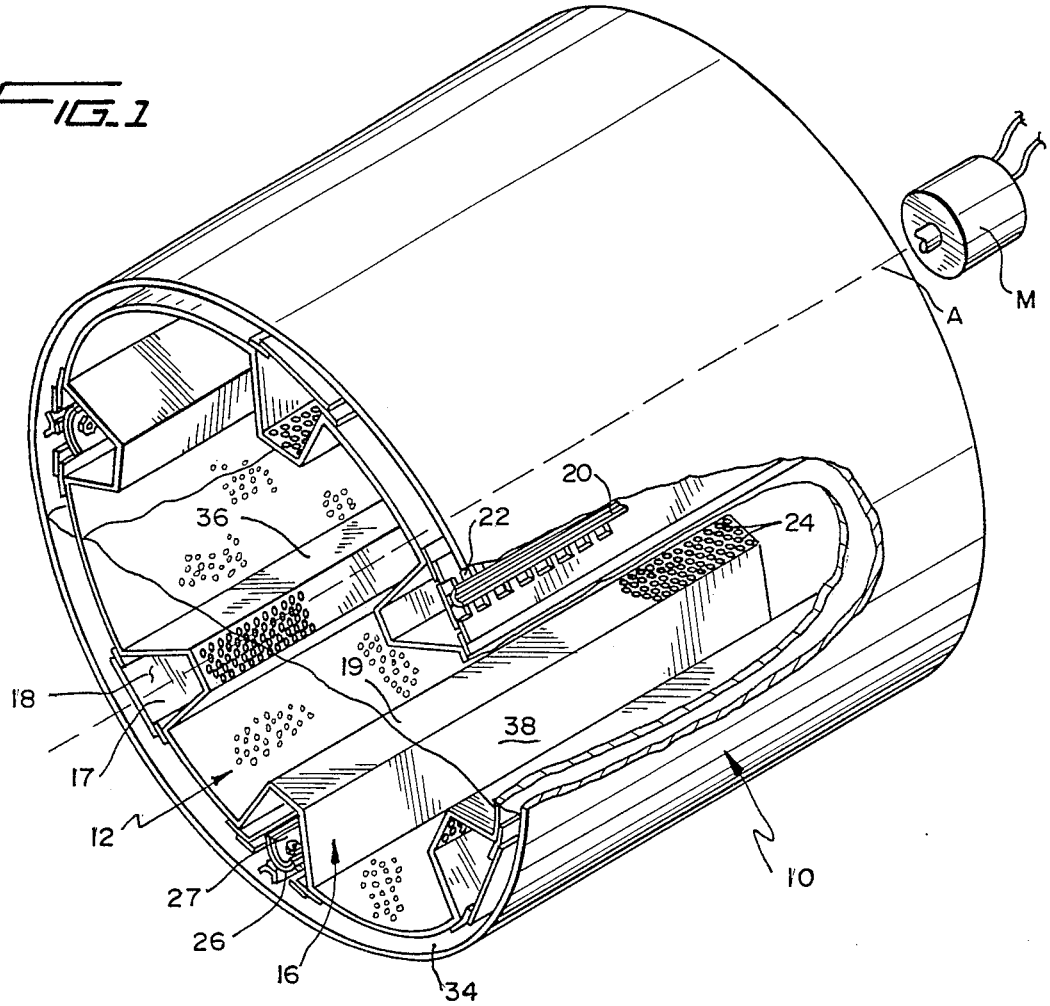
FIG. 1 is a cutaway isometric view of a drum type agitating and mixing machine wherein only the inner rotating drum and outer fixed container are illustrated for clarity.

With reference to the drawings, FIG. 1 illustrates schematically a drum and housing of a drum type agitating and mixing machine useful, for example, in laundering or dyeing fabric, garments or other fabric articles. The remaining parts of the machine are conventional and only the drum and housing are illustrated here for clarity. A drum 12 is driven by motor M in rotation about longitudinal axis A. The drum is supported by suitable trunions or bearings (not illustrated) within an outer shell or housing 10 that is adapted to contain a quantity of liquid such that a side portion of the rotatable drum 12 is partially immersed in the liquid during normal operation of the machine.

In normal use, the housing 10 is partially filled with liquid such as water or other material to which is added a suitable detergent, solvent or dye that is intimately mixed with the main body of liquid. The articles to be washed or dyed are introduced into the interior of the drum 12 through a suitable access opening or door (not illustrated) and the inner drum 12 is rotated to intensely mix the liquid components and to cause the articles to be agitated intensively in the liquid. As the interior drum 12 rotates, each point on the periphery of the drum periodically is submerged in and traverses the liquid and then rises above and over the surface of the liquid, as is well understood.

The drum 12 is provided with agitating and pumping ribs 16 that protrude inwardly from the periphery of the drum 12 towards the rotational axis A. Any practical number of ribs can be utilized, depending upon the intended use of the apparatus. Each rib includes upstanding sides 36, 38 and an inner side 19 closest to the longitudinal axis A. Thus, the sides 36, 38 and 19 define a hollow chamber 18 which is termed a pumping chamber for convenience.

The chamber 18 is further defined by a floor 17 that essentially closes the pumping chamber between the interior of drum 12 and the exterior thereof. The floor 17, as illustrated, comprises a separate element spanning the upstanding sides 36, 38, although it should be understood that the floor 17 could just as well constitute an integral portion of the periphery of drum 12.

Figure 3:
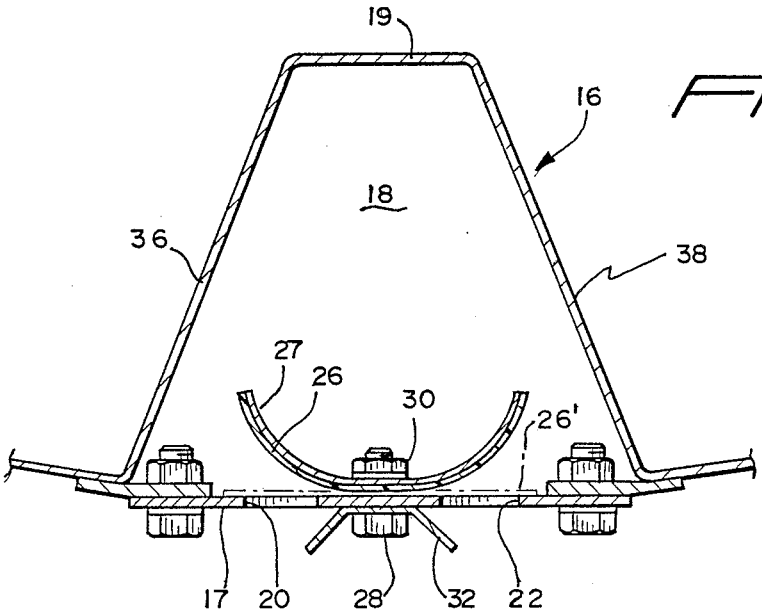
FIG. 3 is an end section view of a pumping rib constructed in accordance with the invention.

The floor 17 is provided with an inlet aperture arrangement constituting two rows of apertures 20, 22. A one-way valve arrangement comprising a resilient flapper element 26 normally covers the inlet apertures 20, 22 in the relaxed normal position of the valve element 26 as illustrated at 26' in FIG. 3. A backing support 27 limits upward movement of the flapper element 26 and provides rigid support for the flapper element when it is fully deflected to open the inlet apertures 20, 22 (see FIG. 3).

On the exterior surface of floor 17, a scoop element 32 is provided between the rows of inlet apertures 20, 22, and extends into space 34 between drum 12 and housing 10. In the preferred embodiment, the scoop element 32, the valve element 26, and backing support 27 are retained by nut and bolt assembly 28, 30. It will be noted that the inlet aperture arrangement of the illustrated embodiment is provided at opposite ends of each adjacent rib, for reasons that will be explained below.

On the inner side 19 of each rib 16, at the opposite end thereof from the inlet apertures 20, 22, an outlet aperture arrangement 24 is provided, the outlet apertures preferably comprising small round openings. The inlet apertures 20, 22 preferably are square in cross section and the total cross sectional area of the inlet apertures 20, 22 is greater than the total cross sectional area of the outlet apertures 24, although it is only necessary that the inlet and outlet apertures have cross sectional areas that promote rapid liquid ingress and trapping of air within the rib chamber 18 in a manner to be described below.

As illustrated in FIG. 4, the operation of the system described above will be apparent. Considering a single pumping rib 16, and assuming that the rib is first observed moving towards the liquid within the housing 10, the pumping chamber 18 will be filled with air and moving downward towards the upper surface of the liquid. Upon immersion in the liquid, the scoop 32 on the leading side of the rib with respect to the direction of rotation will tend to urge liquid into the large inlet apertures 20, 22 on the leading side of the scoop 32, thereby tending to move the flapper valve 26 away from the aperture to admit liquid rapidly into the pumping chamber 18. It is to be noted that the inlet aperture arrangement is located only along a limited axial length of each rib, so that liquid from a limited area in the drum is admitted into the rib to cause the air in the pumping chamber to be compressed and pumped. Fluid will tend to flow in through both sets of inlet apertures 20, 22 due to the effect of the submergence of the rib in the liquid, and the scoop 32 is designed to augment the inlet of fluid through the leading set of inlet apertures with respect to the direction of rotation of the drum. Upon rapid ingress of liquid through the inlet apertures, air in the pumping chamber 18 within the rib 16 is displaced and compressed by the existing head of liquid, and is discharged through the outlet aperture arrangement 24 located (in the illustrated embodiment) at the opposite end of the pumping chamber 18. However, the discharge of the air is delayed because the outlet apertures 24 are smaller as compared with the liquid inlet openings 20, 22, so that air is pumped out of the chamber 18 over an extended period of time while the rib is submerged. As the rib 16 continues to traverse the liquid, eventually the pumping chamber 18 is substantially filled with liquid and air is substantially totally discharged as bubbles beneath the surface of the liquid in the housing 10. The discharge of air in the form of bubbles intensely mixes the liquid and any solvent, detergent or dye contained therein. As an example, the inlet apertures could extend over 9 square inches (58 sq. cms.) and the outlet apertures over 6 square inches (38.7 sq. cms.).

As illustrated in the drawings, and as noted previously, the inlet and outlet aperture arrangements are located at axially opposite ends of each rib. It is to be understood that the inlet aperture arrangement could be located at any area along each rib and likewise the outlet aperture arrangement, provided that the inlet and outlet aperture arrangements are axially separated from each other to effect transfer of liquid axially within the drum as the ribs rotate around and above the liquid in the drum housing.

As the rib 16 under observation rotates out of the liquid in the housing 10, the liquid within the chamber 18 is prevented from discharging out back through the inlet apertures 20, 22 by the flapper valve 26 and is forced to discharge inwardly through outlet openings 24 at the other end of the chamber 18. Liquid will continue to be discharged from the apertures 24 as the rib continues its rotation over the top of the body of liquid is inverted and as it rotates back towards the liquid as it approaches its first observed position. This constant discharge of liquid back into the fabric or clothing that is being agitated or tumbled within the drum further enhances the washing action of the liquid on the garments or textile in the drum. Of course, each of the adjacent ribs experiences the same pumping action as it traverses the body of liquid as the drum rotates about its rotational axis A. As the liquid pours out of the outlet openings 24, air is sucked into the inlet apertures 20, 22 to fill the pumping chamber with air again.

It should be understood that various modifications can be made to the preferred embodiment without departing from the spirit and scope of the invention as recited in the claims hereinbelow. The particular shape of the ribs, for example, can be adjusted to suit the intended use of the agitating and mixing machine. The particular shape and configuration of the inlet and outlet aperture arrangement likewise can be modified to optimize the desired air pumping action and liquid mixing that occurs upon immersion of the ribs in liquid, and the outflow of liquid in the drum. Also, any valve arrangement that will readily permit ingress of fluid but prevent immediate outflow of liquid through inlet apertures 20, 22 can be utilized instead of the flapper valve arrangement illustrated. Essentially, it is important that the air be pumped from the chamber 18 after the rib 16 has been totally immersed in liquid, so it is desirable that the air cannot escape from chamber 18 as fast as liquid enters the chamber. Accordingly, it is desirable that the liquid flow quickly into chamber 18 while air escape at a slower rate so that it is forced to be discharged as air bubbles beneath the surface of the liquid in the housing 10 as the rib traverses the liquid. The specific relationship between the drum and its housing is not critical, although it is quite typical to utilize concentric cylinders for the rotating drum 12 and the housing 10. The only essential feature is that a side area of the inner drum 12 be partially immersed in liquid to achieve the desired pumping action.

I claim:

1. In a drum type agitating and mixing machine adapted for treating fabric in liquid and including a drum rotatable about a longitudinal axis and having at least one generally longitudinally extending hollow rib projecting radially inwardly of the interior of the drum, the improvement comprising:

said rib defining an elongated hollow pumping chamber within the rib;

an outlet aperture arrangement defining an outlet flow area on the rib providing communication between the pumping chamber and the interior of the drum;

an inlet aperture arrangement defining an inlet flow area in the drum providing communication between the exterior of the drum and pumping chamber;

said inlet aperture arrangement having a cross sectional area larger than the cross sectional area of said outlet aperture arrangement;

drive means rotating said drum such that a side thereof is partially immersed in a body of liquid so that the rib initially with air inside is periodically submerged in and lifted above the liquid, causes liquid to periodically enter the pumping chamber via the inlet aperture arrangement upon submersion of the rib, air within the pumping chamber to be periodically pumped out through the outlet aperture arrangement by the force of liquid entering the liquid aperture arrangement while the rib undergoes submersion, and liquid to be drained from the pumping chamber through the outlet aperture arrangement when the rib moves out of the liquid and is inverted.

2. The improvement in a drum type agitating and mixing machine as claimed in claim 1, wherein said inlet and outlet aperture arrangements are axially spaced from each other along the rib.

3. The improvement in a drum type agitating and mixing machine as claimed in claim 1 or 2, further comprising a plurality of circumferentially spaced ribs and wherein the inlet and outlet aperture arrangements on adjacent ribs are respectively axially spaced apart from each other.

4. The improvement in a drum type agitating and mixing machine as claimed in claim 1 or 2, further comprising liquid scoop means for directing liquid from outside the drum into the pumping chamber via the inlet aperture arrangements when the scoop moves through a body of liquid.

5. The improvement in a drum type agitating and mixing machine as claimed in claim 3, further comprising liquid scoop means for directing liquid from outside the drum into the pumping chamber via the inlet aperture arrangements when the scoop moves through a body of liquid.

6. The improvement in a drum type agitating and mixing machine as claimed in claim 1, wherein said inlet aperture arrangement includes distinct rows of apertures located so as to provide at least a first row of apertures disposed towards the leading rib side of rotation of the drum and at least a second row of apertures disposed towards the trailing rib side of rotation of the drum when the drum is rotated.

7. The improvement in a drum type agitating and mixing machine as claimed in claim 4, wherein said inlet aperture arrangement includes distinct rows of apertures located so as to provide at least a first row of apertures disposed towards the leading rib side of rotation of the drum and at least a second row of apertures disposed towards the trailing rib side of rotation of the drum when the drum is rotated, said first and second rows of apertures disposed on opposite sides of said liquid scoop means.

8. The improvement in a drum type agitating and mixing machine as claimed in claim 5, wherein said inlet aperture arrangement includes distinct rows of apertures located so as to provide at least a first row of apertures disposed towards the leading rib side of rotation of the drum and at least a second row of apertures disposed towards the trailing rib side of rotation of the drum when the drum is rotated, said first and second rows of apertures disposed on opposite sides of said liquid scoop means.

9. The improvement in a drum type agitating and mixing machine as claimed in claim 1 or 2, further comprising a one-way valve means for controlling the flow of liquid through said inlet aperture arrangement such that a liquid can flow into the pumping chamber through the inlet aperture arrangement but not in a reverse direction.

10. The improvement in a drum type agitating and mixing machine as claimed in claim 6, further comprising:

a one-way valve means for controlling the flow of liquid through said inlet aperture arrangement such that a liquid can flow into the pumping chamber through the inlet aperture arrangement but not in a reverse direction.

11. The improvement in a drum type agitating and mixing machine as claimed in claim 9, wherein said one-way valve means comprises a flexible cover disposed in normally sealing relationship over the inlet aperture arrangement but moveable away from the inlet aperture arrangement by flexing at least upon impingement of liquid force thereagainst from outside the drum towards the pumping chamber.

12. The improvement in a drum type agitating and mixing machine as claimed in claim 10, wherein said one-way valve means comprises a flexible cover disposed in normally sealing relationship over the inlet aperture arrangement but moveable away from the inlet aperture arrangement by flexing upon impingement of liquid force thereagainst from outside the drum towards the pumping chamber.

* * * * *